US005627562A

United States Patent [19]

Skodlar

[11] Patent Number: 5,627,562

[45] **Date of Patent: *May 6, 1997**

[54] MAGNETIC DISPLAY APPARATUS

[76] Inventor: Rafael Skodlar, 1585 Keesling Ave., San Jose, Calif. 95125

[ * ] Notice: The term of this patent shall not extend beyond the expiration date of Pat. No. 5,359,183.

[21] Appl. No.: 401,479

[22] Filed: Mar. 2, 1995

Related U.S. Application Data

[63] Continuation of Ser. No. 157,316, Nov. 26, 1993, abandoned.

[51] Int. Cl.[6] ..... G09G 3/00

[52] U.S. Cl. ..... 345/111; 345/169; 40/449; 235/493; 281/DIG. 1

[58] Field of Search ..... 345/84, 85, 107, 345/111, 169; 235/493, 472, 486, 449; 40/449; 281/2, 5, DIG. 1; 434/408, 409; 400/83, 161.1; 341/22

[56] References Cited

U.S. PATENT DOCUMENTS

| | | | |
|---|---|---|---|
| 3,633,720 | 1/1972 | Tyler | 434/409 |
| 3,838,764 | 10/1974 | Decker | 400/161.1 |
| 4,125,419 | 11/1978 | Hamisch, Jr. | 156/277 |
| 4,580,916 | 4/1986 | Rolfo et al. | 400/83 |
| 4,820,064 | 4/1989 | Sato et al. | 400/175 |
| 4,888,709 | 12/1989 | Revesz et al. | 340/825.07 |
| 5,227,617 | 7/1993 | Christopher et al. | 235/462 |
| 5,290,066 | 3/1994 | Mody | 283/67 |
| 5,359,183 | 10/1994 | Skodlar | 235/493 |

*Primary Examiner*—Ulysses Weldon
*Assistant Examiner*—Lun-Yi Lao
*Attorney, Agent, or Firm*—Paul F. Schenck

[57] ABSTRACT

Apparatus for magnetically erasing and writing data stored in human readable displays of product label. The product label includes a display area with magnetic particles which can be oriented by external magnetic field in shapes including human readable figures and symbols. The so oriented magnetic particles retain their position when the external field ie removed, thereby storing the recorded information in the form of the figures and symbols. A portable apparatus includes electrically controllable write magnets for writing the figures and symbols, and an electrically controllable erase magnet for erasing previously recorded figures and symbols. The controllable magnets are mounted in a write/erase head which is self-adapting to the surface of the label.

11 Claims, 5 Drawing Sheets

MAGNETIC DISPLAY APPARATUS

This application is a continuation of application Ser. No. 08/157,316 filed on Nov. 26, 1993, now abandoned.

FIELD OF THE INVENTION

The present invention relates to low cost magnetically actuated information display devices. More particularly, it relates to passive magnetic display devices where the image is formed by a separate device. Its use includes price tags on shelves and goods in stores, labels in warehouses, information tags for use in libraries, and vending machines.

BACKGROUND OF THE INVENTION

Traditionally, price labels for products on store shelves are preprinted and inserted into a slot provided for that purpose. Whenever the prices of articles on the shelves change, which may happen daily, the price labels need to be replaced with new ones. Accordingly, that requires printing new labels and replacing old ones in the provided places.

Libraries use paper labels to write the date due for return of books, CD discs, or magazines. Handwriting leads to errors and discrepancy between the computer records and the labels.

Video tapes are available for rent from video stores and vending machines without the provision for recording of the due date of return on the tape itself.

SUMMARY OF THE INVENTION

It is an object of this invention to provide an inexpensive way to make an entry on labels and tags, whereby the entry remains readable until erased or rewritten. Labels and tags thus become recyclable at the point of use.

It is yet a further object of the present invention to provide means to change the entry on the labels when needed.

It is an object of the present invention to provide a magnetic display apparatus including intelligence capabilities to receive and process data, and to write such data onto a magnetic display label.

DETAILED DESCRIPTION OF THE INVENTION

The present invention includes a label with an area for displaying data which are magnetically written onto that area, and an apparatus for writing such data and erasing data previously written onto that area. Basically the present invention includes two parts: a magnetic display and a display altering apparatus. The display is a part of label, tag or object and shows the human readable symbols that were written onto it by the apparatus. The apparatus erases the display prior to writing new symbols or image.

Such labels with magnetic display can be used in combination with shelfmounted label holders and on individual items such as library books. When the latter are released to the borrower, the magnetic display may contain the due date of return. With sufficient protection these labels may be used in combination with videotapes for rent.

The apparatus for writing human readable symbols on magnetically sensitive display areas of labels comprises: an image forming or erasing magnetic write/erase head, data processing means and drivers for the magnetic write/erase head, as well as data entry means coupled to data processing means.

DESCRIPTION OF THE PREFERRED EMBODIMENT

Figure 1:
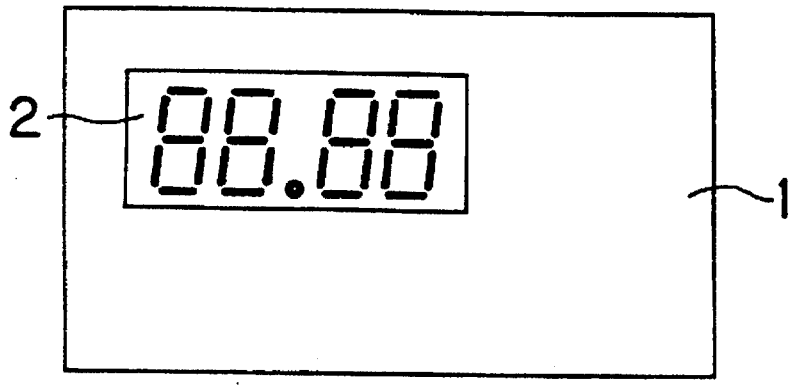
FIG. 1 is an illustration of a price label with a magnetic display and numerical characters generated by the label writing apparatus of the present invention.

FIG. 1 is an illustration of a price label 1 with the magnetic display area 2. Price label X traditionally carries preprinted information on product name, price, and unit of measure. A thin magnetic film makes magnetic display area 2, which is either embedded in or adhesively attached to the price label 1. Magnetic film is a transparent plastic foil coated with microscopic magnetic particles suspended in oil where they float. Tiny bubbles are molded on a film typically 0.15 mm (0.006") thick. When the information is written onto the magnetic display area, the tiny magnetic particles align themselves with the magnetic lines of force and remain in that position. This action affects the way light is reflected by the aligned tiny magnetic particles versus non-aligned particles, thereby changing the color or intensity of the reflected light and revealing the magnetically written information.

Figure 2A:
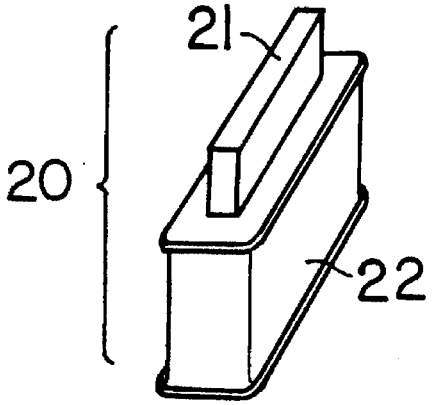
FIGS. 2*a*, 2*b*, and 2*c* are illustrations of electromagnets which are part of a write head assembly of a label writing apparatus.
Figure 2B:
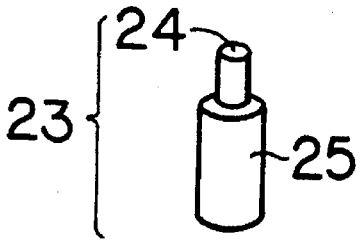
Figure 2C:
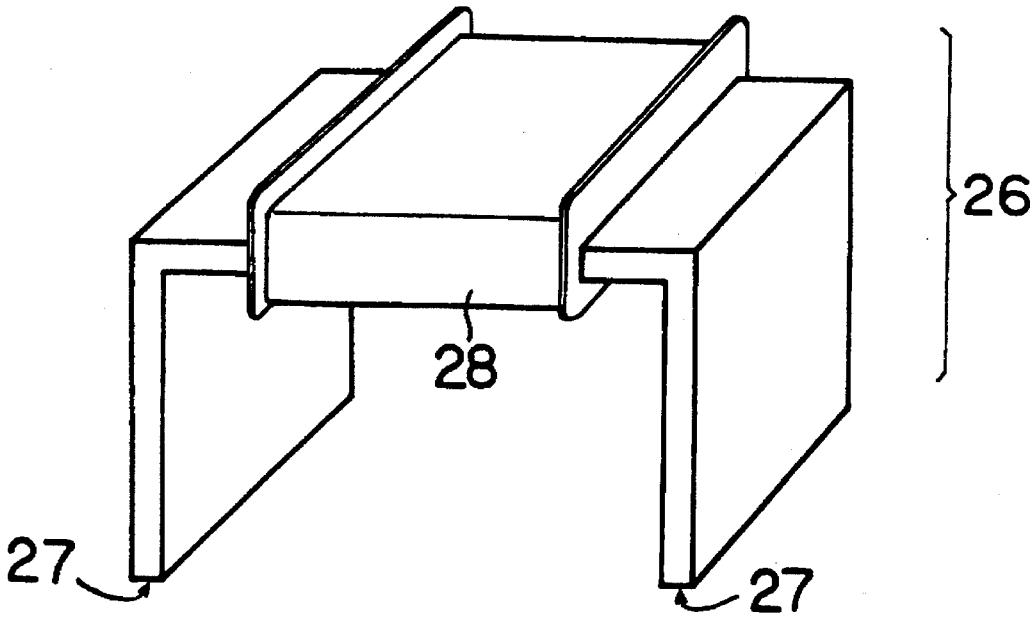
Figure 3:
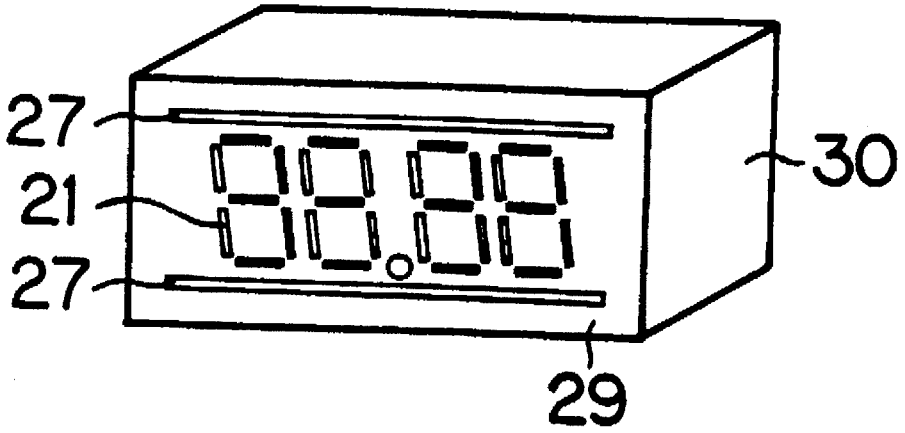
FIG. 3 is an perspective illustration of a write head assembly of a label writing apparatus.

FIGS. 2*a* through 2*c* are illustrations of the three types of electromagnets of write/erase head 30 of FIG. 3 which is used to erase and write information onto the display area. The functions of write/erase head 30 are subdivided as follows:

- seven electromagnets 20 for seven display segments used for displaying numbers (see FIG. 2*a*),
- electromagnet 23 for displaying a decimal point (see FIG. 2*b*), and
- electromagnet 26 for generating a magnetic field erasing any information stored in a display area 2 of FIG. 1 (see FIG. 2*c*).

FIG. 2*a* shows electromagnet 20 with core 21 and coil 22. Core 21 is one of 7 segments forming a numeric character "8". It is well known in the art how to form other characters with the combination of active and inactive segments.

FIG. 2*b* shows electromagnet 23 with core 24 and coil 25. Electromagnet 23 activates magnetic field to form a decimal point on the magnetic display 2 and is also part of write/erase head 30.

FIG. 2*c* is a view of electromagnet 26 with core 27 and coil 28. Electromagnet 26 is used for the erase function of write/erase head 30. When electromagnet 26 is energized, it polarizes with a strong magnetic field all microscopic magnets in magnetic display area 2. Polarization is in one direction thus forming a uniform color without recognizable pattern in magnetic display 2.

As shown in FIG. 3 a four digit magnetic write/erase head 30 can be used to write numerical values up to "9999". Head 30 includes a decimal point between two groups of two digits. Other patterns can be generated by using a write head with more magnets arranged in a similar pattern as shown in FIG. 3.

FIG. 3 shows the front surface 29 of write/erase head 30. Surface 29 is placed on top of magnetic display area 2 to write a desired image onto display area 2 or to erase previously written information. Front surface of core 21 is one segment of numeric character "8", while front surface of core 24 forms a decimal point. A combination of energized electromagnets 20 form a human readable character. Front surface of core 27 is part of erase electromagnet 26.

Figure 4:
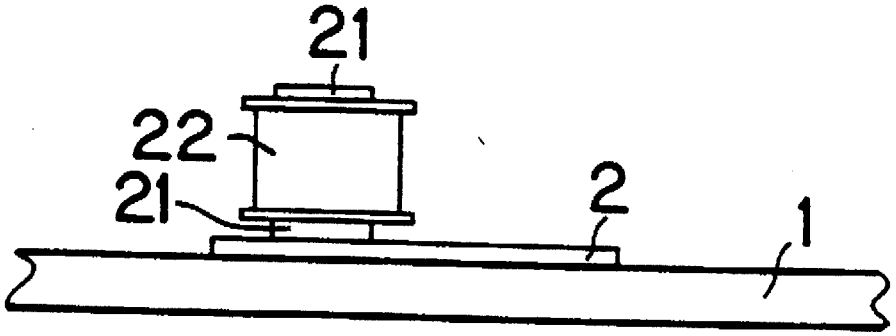
FIG. 4 is a view of the write head segment/label interface.

FIG. 4 is a view of electromagnet 20 with its coil 22 and core 21. Core 21 touches magnetic display area 2 during the write or erase process.

Figure 5A:
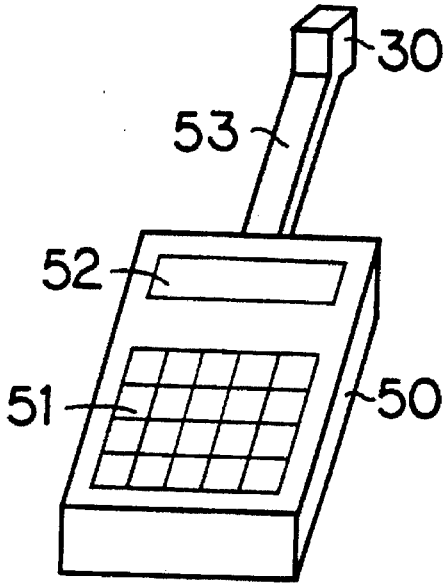
FIGS. 5*a* and 5*b* are perspective views of hand held label writing apparatuses.

FIG. 5*a* is a perspective view of a hand held apparatus 50 for writing numeric characters onto a magnetically sensitive displays area 2. Keyboard 51 is used for data entry and write/erase commands. LCD display 52 shows the entered data and commands to the user. Magnetic write/erase head 30 is pivot mounted on extension arm 53. Pivot mounting allows easy adaptation of the magnetic write/erase head 30 to the mounting angle of magnetic display area 2.

Figure 5B:
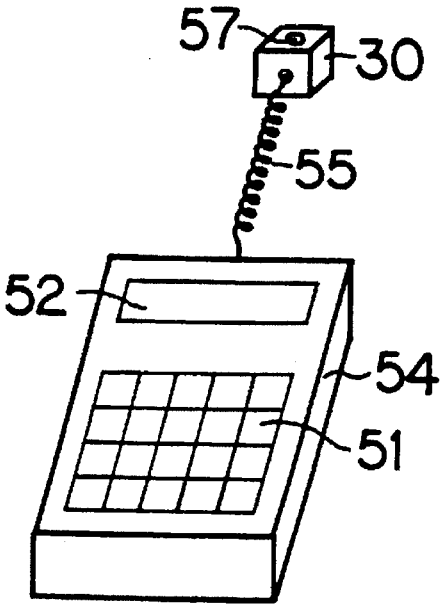
Figure 6:
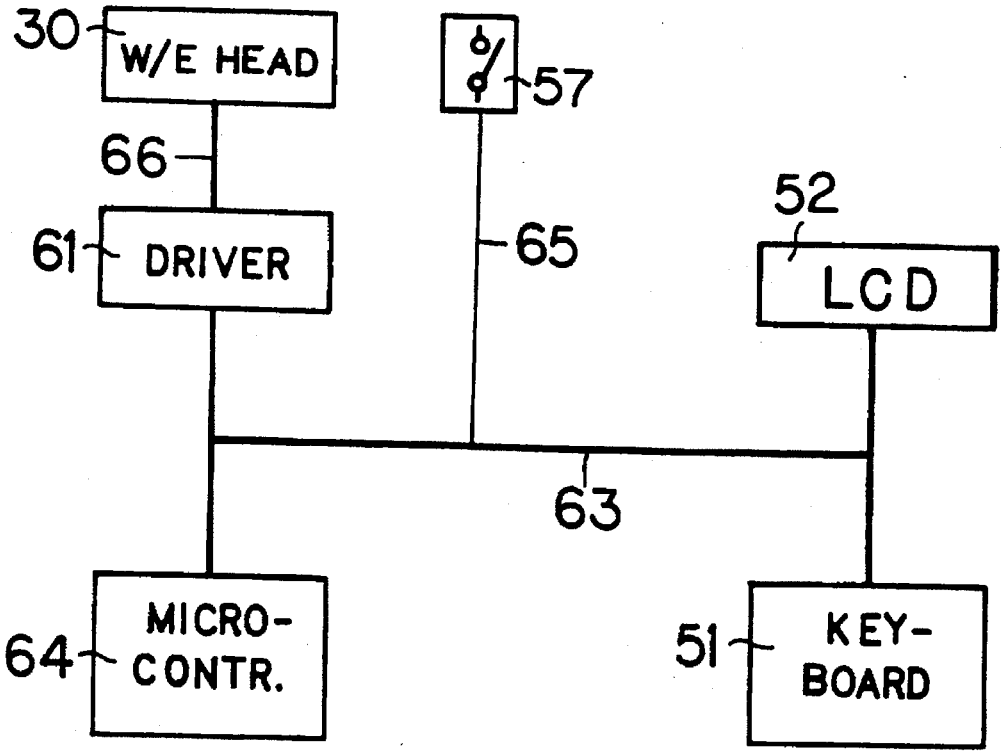
FIG. 6 is an illustration of a logic diagram of the magnetic label writing apparatus.

Hand held apparatus 54 shown on FIG. 5*b* includes an enclosure 54 with a keyboard 51, LCD display 52, and electronic section of which a schematic diagram is shown in FIG. 6. Separated write/erase head 30 is connected to apparatus 54 by a flexible cord 55. This cord contains data lines 64 to the erase/write head 30 and may include control lines 65 from switch 57 to control and data bus 63 (see FIG. 6), if the write/erase command switch 57 is mounted at write/erase head 30. Data is entered using keyboard 51 while the write/erase command is given by push button switch 57.

FIG. 6 is a block diagram of the electronic control circuit of the apparatus. Microcontroller 64 communicates over data and control bus 63. It reads signals from the keyboard 51, puts instructions and information for the user on the LCD 52 and activates drivers 61 for write/erase head 30. When the write/erase head 30 is separated by flexible cord 55 write/erase switch 57 is connected with lines 65 to bus 63. First the data is entered through the keyboard 51 then write/erase head 30 is positioned over the magnetic display 2 and switch 57 is pressed for the write/erase command. A write operation is preceded by an erase cycle in which data previously recorded in magnetic display area 2 (FIG. 1) are erased prior to recording new data in a write cycle. During erase cycle and write cycle the write/erase head 30 in FIGS. 5A and 5B has to be in close proximity to the magnetic display area.

The apparatus includes control means for detecting completion of an erase-write sequence. These control means have to monitor that head 30 is in sufficient close proximity to the magnetic display area to perform a successful erase cycle followed by a write cycle. It is within the scope of the artisan in the field to provide means for determining that the write/erase head was in close proximity to the magnetic display area during the erase/write process and to indicate completion or failure of the write/erase operation.

Figure 7:
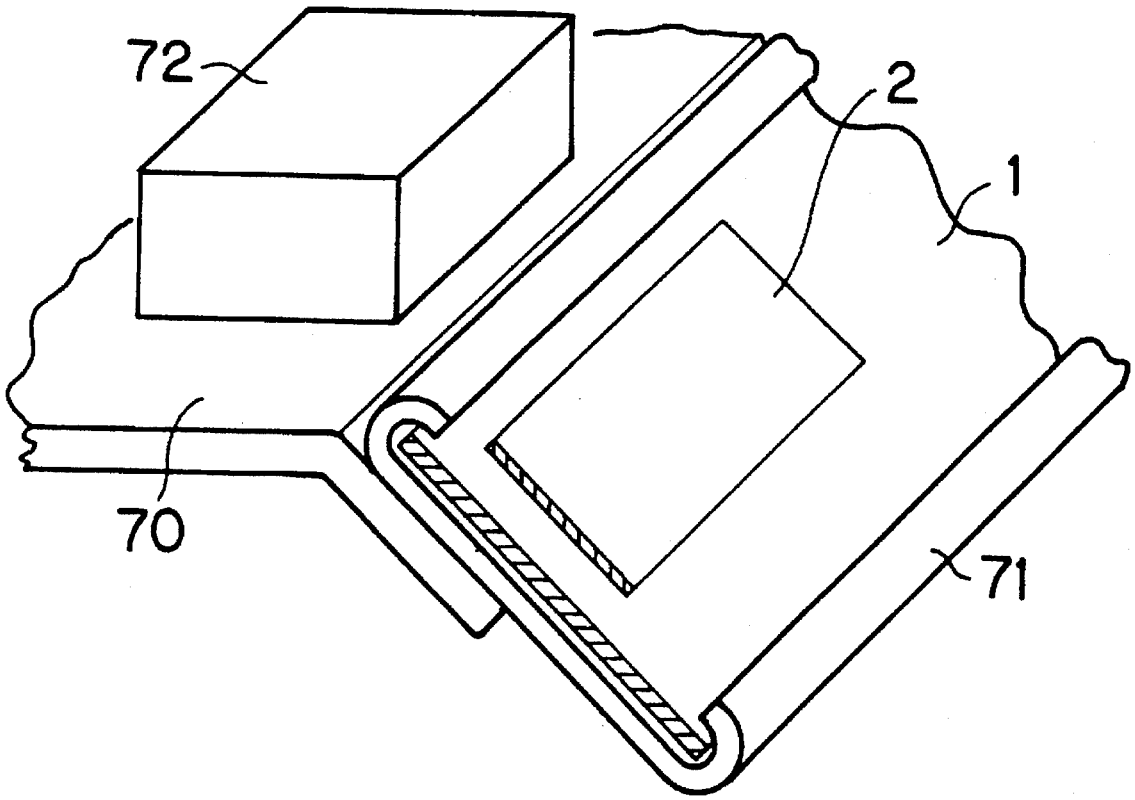
FIG. 7 is an illustration depicting a label with a magnetic display on the store shelf.

Price label 1 with magnetic display area 2 mounted in price label holder 71 which is part of the store shelf 70 are shown on FIG. 7. Item for sale 72 is stored on the shelf 70.

Figure 8:
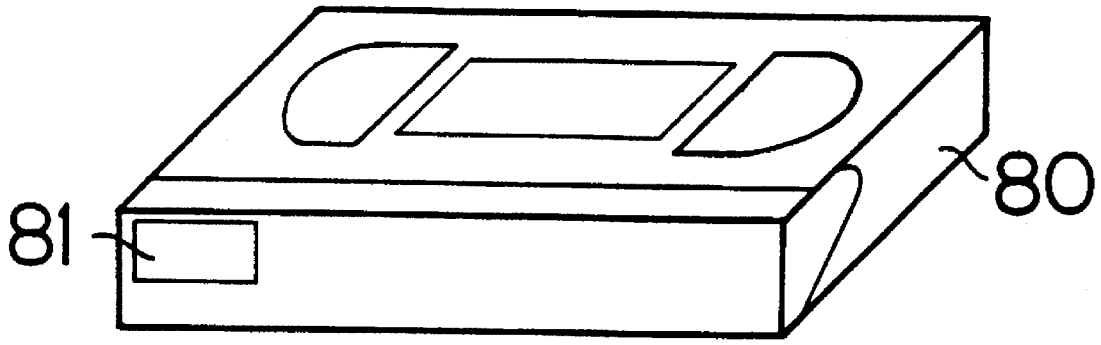
FIG. 8 is a view of a VCR tape with the magnetic display label.

FIG. 8 is a perspective view of a standard VHS video tape cartridge 80. Magnetic display 81 is adhesively or otherwise attached to the cartridge 80 in place where foreign magnetic field is not going to change the recording on the magnetic tape.

Figure 9:
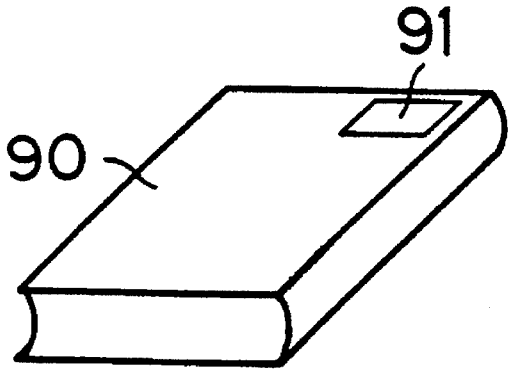
FIG. 9 is a view of a book with magnetic display label.

FIG. 9 shows a magnetic display 91 adhesively or otherwise attached to the book 90 or similar article. A device similar to hand held apparatus 50 or 54 can be used to write the date of return on the book or article.

In the above preferred embodiment an apparatus uses keyboard 51 for data entry. It is considered to be within the scope of the artisan skilled in the art to combine this apparatus with other functional apparatus such as inventory control. It is also considered that the data for writing on magnetic display on VHS cartridge and books may come from personal computers that are used for the inventory and patrons records.

What I claim is:

1. A labeling system for providing human readable information on a label comprising said label including a multi-character display area for displaying said human readable information, said information being magnetically recorded and stored in said display area;

said label being devoid of any power supply and retaining said magnetically recorded human readable information until said human readable information is altered by magnetically recording different human readable information in another recording operation;

a recording apparatus for magnetically recording data representing said human readable information onto said display area, including a keyboard for entering data and commands, a write head for generating magnetic fields, and processing means for receiving said data and generating control signals for said write head for generating said magnetic fields;

said write head including a plurality of electromagnets arranged for recording said data representing said human readable information in said display area;

said write head being void of any mechanical linkage to said label and being moved into operational proximity to said label for recording said human readable information into said multi-character display area.

2. A labeling system as claimed in claim 1, wherein said keyboard and said processing means are contained in an enclosure, said display area having a surface, and wherein said write head is pivotally mounted on an extension arm of said enclosure for aligment of said write head with said surface of said display area.

3. A labeling system as claimed in claim 1, wherein said keyboard and said processing means are contained in an enclosure, and wherein said write head is connected to said enclosure by a cable only.

4. A labeling system as claimed in claim 1, wherein said write head includes a plurality of magnets for generating human readable seven-segment display characters in said display area.

5. A labeling system as claimed in claim 1, wherein said write head includes a plurality of electromagnets for generating human readable seven-segment display characters and a magnet for generating a decimal point.

6. A labeling system as claimed in claim 2, wherein said pivotally mounted write head is springloaded.

7. A labeling system as claimed in claim 3, wherein a command execution switch for initiating a write operation is mounted on said write head.

8. A labeling system as claimed in claim 1, wherein said write head includes at least one electromagnet for erasing information previously written onto said display area.

9. A labeling system as claimed in claim 1, wherein said keyboard includes means for causing said write head to erase information previously written onto said display area.

10. A labeling system as claimed in claim 1, wherein said label is part of a shelf system.

11. A labeling system as claimed in claim 1, wherein said keyboard and said processing means are contained in an enclosure, and wherein said system further includes means for displaying said data and said commands entered at said keyboard.

* * * * *